US005099562A

United States Patent [19]

Loughran

[11] Patent Number: 5,099,562

[45] Date of Patent: Mar. 31, 1992

[54] HINGE PIN AND TIP REMOVAL TOOL

[75] Inventor: David Laughran, Southington, Conn.

[73] Assignee: The Stanley Works, New Britain, Conn.

[21] Appl. No.: 663,405

[22] Filed: Mar. 1, 1991

[51] Int. Cl.[5] ..... B25B 27/14

[52] U.S. Cl. ..... 29/275; 16/380

[58] Field of Search ..... 24/239, 244, 275, 278; 16/380, 386

[56] References Cited

U.S. PATENT DOCUMENTS

| | | | |
|---|---|---|---|
| 1,510,866 | 10/1924 | Seppmann | 29/275 |
| 1,588,687 | 6/1926 | Richter | 29/275 |
| 1,667,227 | 4/1928 | Thompson | 29/275 |
| 1,863,956 | 6/1932 | Wilson . | |
| 2,846,715 | 8/1958 | Clifton, Jr. | 16/380 D |
| 3,152,356 | 10/1964 | Parsons | 16/380 |
| 4,183,133 | 1/1980 | Abbott | 29/275 |
| 4,432,125 | 2/1984 | Monteleone et al. | 29/275 |

*Primary Examiner*—J. J. Hartman

[57] ABSTRACT

A hinge pin and tip removal tool is used in combination with a hinge having a pair of hinge leaves having interfitting knuckles cooperating to provide a barrel with a pin receiving cavity extending therethrough, a hinge pin with a head at one end of the barrel and a shank extending in the barrel cavity and a tip seated in the other end of the barrel cavity and having a passage extending axially therethrough. The tool has one end portion of a first diameter smaller than the passage in the tip for insertion therethrough to drive the hinge pin away from the tip, its other end portion has a larger diameter cooperatively dimensioned with the cavity of the barrel for insertion into its end into the barrel after removal of the pin to drive the tip outwardly of the other end.

3 Claims, 2 Drawing Sheets

HINGE PIN AND TIP REMOVAL TOOL

BACKGROUND OF THE INVENTION

The present invention relates to hinges of the type employing hinge pins and decorative tips, and more particularly to a combination of such hinges with a tool for removing the pins and tips therefrom.

Hinges formed by a pair of leaves having cooperating knuckles to provide a barrel seating a hinge pin are widely employed. Generally, it is desirable that the hinge pin be firmly secured within the barrel so that it will not rise during use and produce inadvertent disengagement of the two hinge leaves. To effect removal of the hinge pin from the barrel when the bottom of the bore of the barrel is open, it is common to insert a nail, screwdriver or other tool into the lower end and to drive the hinge pin outwardly of the barrel by the application of force to the nail or other tool. In some instances, the bottom of the barrel may be closed, but the hinge pin has a relatively large diameter head. In such a case, a screwdriver with a thin blade, a putty knife, or a like tool may be forced between the abutting faces of the head of the pin and the knuckle so as to allow the hinge pin to be pried upwardly.

In some hinge constructions, it is desirable to produce symmetry in the hinge, and decorative tips are inserted into the end of the hinge barrel opposite that seating the head, and the decorative tips are configured to approximate the appearance of the head. To remove such tips, a prying action of the type described hereinbefore may be employed, or a relatively large diameter tool may be inserted into the bore of the hinge barrel after the hinge pin has been removed in order to effect downward force on the tip to drive it outwardly of the bore.

Unfortunately, "adapted" tools of the type described above may be improperly selected or used, thus resulting in marring of the exterior finish of the hinge or damage to the hinge pin, bearings and/or tip. Moreover, an appropriately sized tool may not be readily available.

It is an object of the present invention to provide a novel combination of a hinge of the type having a barrel seating a headed hinge pin and a cooperating decorative tip with a novel tool to effect removal of the hinge pin and tip therefrom.

It is also an object to provide such a combination in which the pin and tip removal tool may be readily fabricated and is simple and effective to use so that damage to the hinge and its components is substantially avoided.

Another object is to provide such a combination in which the hinge pin and tip may be readily removed from the hinge barrel with minimal effort and little likelihood of injury to the hinge components.

SUMMARY OF THE INVENTION

It has now been found that the foregoing and related objects may be readily attained in a pin and removal tool which is used in combination with a hinge having a pair of hinge leaves having interfitting knuckles cooperating to provide a barrel with a pin receiving bore or cavity extending therethrough, a hinge pin with a head at one end of the barrel and a shank extending in the barrel cavity, and a tip seated in the other end of the barrel cavity and having a passage extending axially therethrough. The removal tool has one end portion of a first diameter smaller than the passage in the tip for insertion therethrough to drive the hinge pin away from the tip, and its other end portion is of a larger diameter cooperatively dimensioned with the cavity of the barrel for insertion into the one end of the barrel after removal of the pin to drive the tip outwardly of the other end. Desirably, the two end portions of the tool comprise the full length thereof, and the other end portion is of greater length than the one end portion, and the tool is of greater length than the barrel. Preferably, the tool is of circular cross section, and its ends are chamfered.

In a method for removing the hinge pin and tip, the one end portion of the tool is inserted into the passage of the tip and an axial force is applied to the tool to drive the hinge pin in the barrel away from the tip. The hinge pin is removed from the barrel, and the other end of the tool is inserted into the end of the barrel from which the hinge pin was removed. The smaller diameter portion of the tool enters the passage of the tip and the shoulder rests against the inner end of the tip. Axial force is then applied to the tool to drive the tip outwardly of the cavity.

DETAILED DESCRIPTION OF PREFERRED EMBODIMENT OF THE INVENTION

Figure 1:
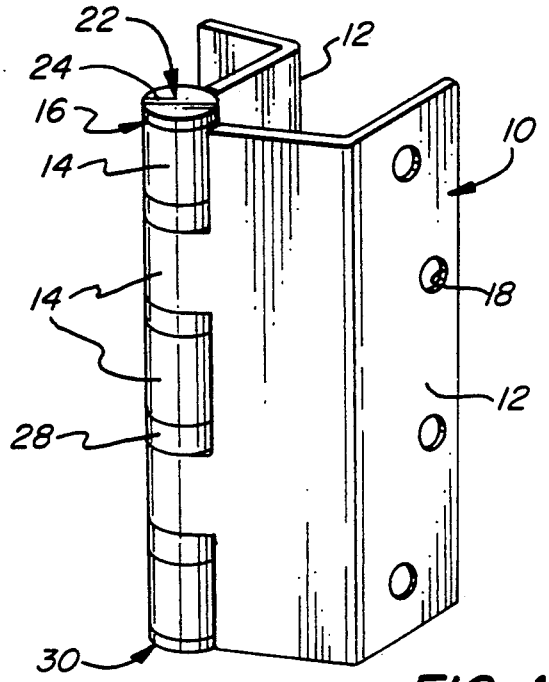
FIG. 1 is a perspective view of a typical offset hinge having a pair of hinge leaves providing a barrel in which are seated a headed hinge pin and a tip.
Figure 2:
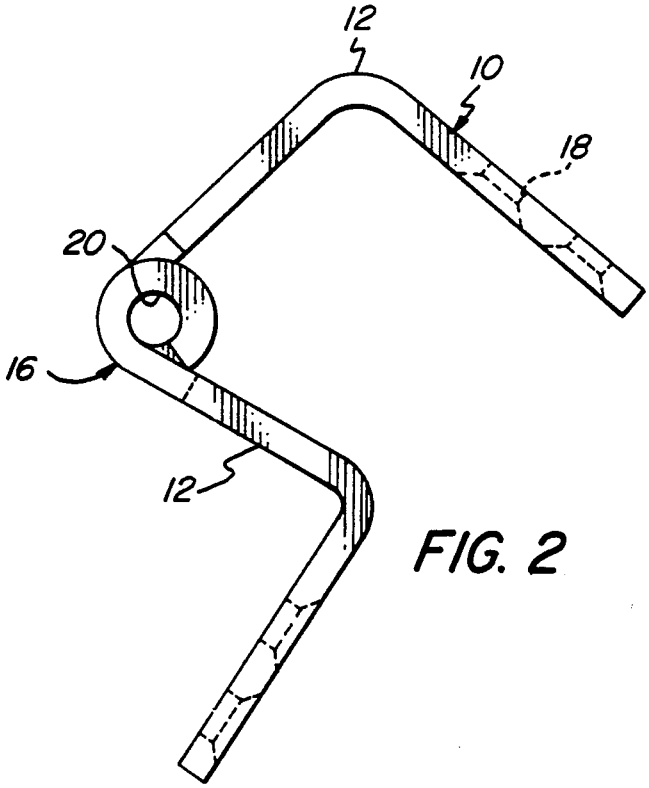
FIG. 2 is a top plan view thereof with the pin and tip removed.

Turning first to FIGS. 1 and 2, therein illustrated is a hinge generally designated by the numeral 10, which is of the offset type frequently employed in connection with concealed installations or cabinets. The hinge 10 has a pair of hinge leaves 12 with apertures 18 therein for seating fasteners (not shown) to secure the hinge 10 to the supporting structures upon which used. Along their abutting ends, the leaves 12 have rolled over portions providing knuckles 14 which interfit to provide the hinge barrel generally designated by the numeral 16. In this hinge 10, thrust bearings 28 are provided between adjacent knuckles 14.

Figure 6:
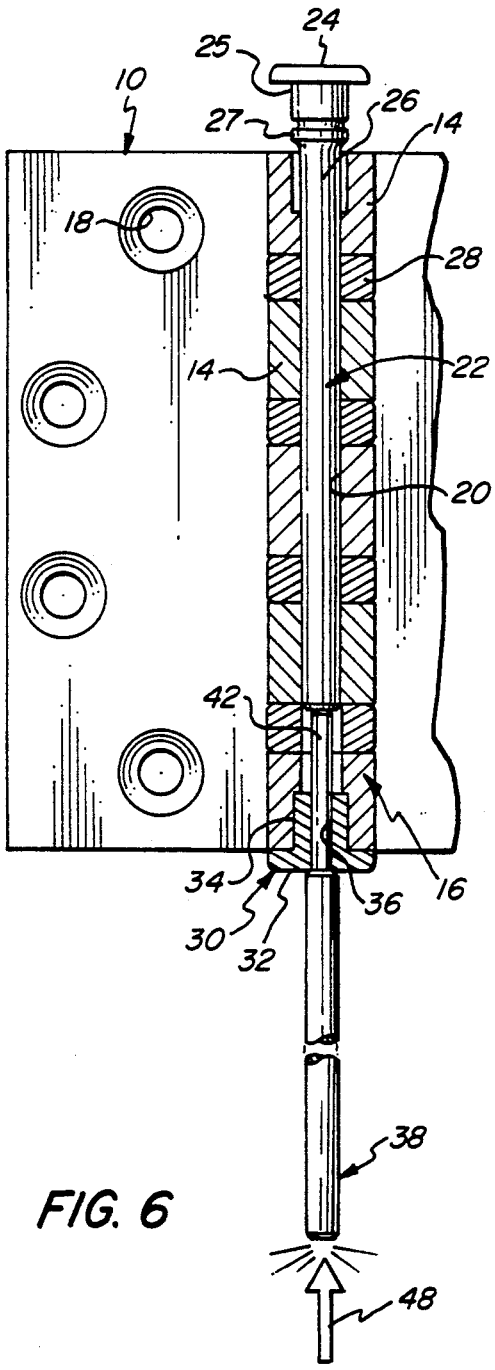
FIG. 6 is a view of a hinge in partial section through the barrel showing the pin and tip removal tool of the present invention inserted through the aperture in the tip, and the process of driving the hinge pin upwardly and outwardly of the barrel.
Figure 7:
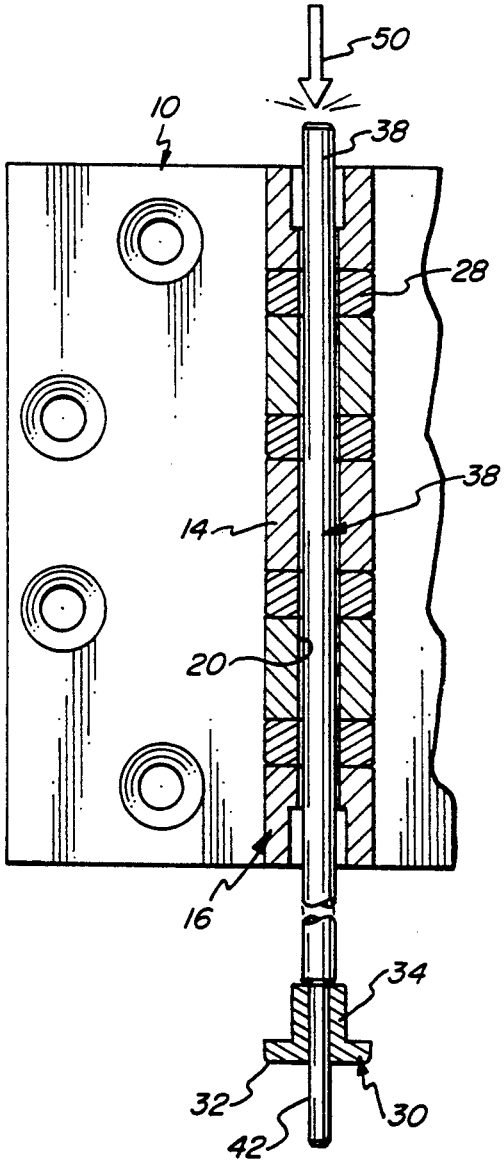
FIG. 7 is a similar view with the pin and tip removal tool inserted into the barrel after removal of the pin and into the aperture of the tip and showing the process of driving the tip outwardly of the barrel.

A hinge pin generally designated by the numeral 22 is seated in the barrel 16, and, as best seen in FIG. 6, it has an enlarged head 24 and an elongated shank 26 which extends downwardly into the bore 20 formed within the knuckles 14 of the hinge barrel 16. The shank 26 is axially dimensioned so as to terminate inwardly of the opposite end of the hinge barrel 16, and a tip generally designated by the numeral 30 is seated therein.

As seen in FIG. 6, the tip 30 has a head 32 which is cooperatively dimensioned so as to overlie the end surface of the knuckle 14 and provide a degree of symmetry with respect to the head 24 of the hinge pin 22. The tip 30 also has a shank 34 which extends into an enlarged portion of the bore 20 to seat the tip 30 firmly therewithin. Extending coaxially through the tip 30 is a passage 36 which is of smaller radial dimension than the bore 20. In this embodiment, the head 24 of the hinge pin 22 has a portion 25 which extends into the bore 20 and below which is a collar 27. The portion 25 and collar 27 seat snugly within the enlarged portion of the bore 20 to retain the pin 22 therein.

Figure 3:
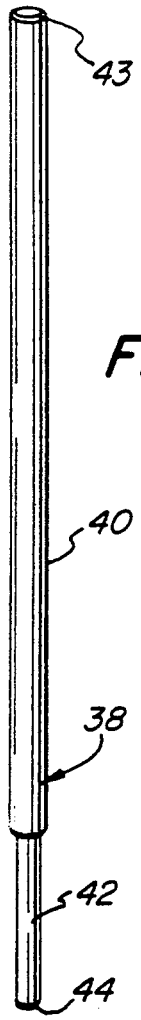
FIG. 3 is a perspective view of a pin and tip removal tool of the present invention.
Figure 4:
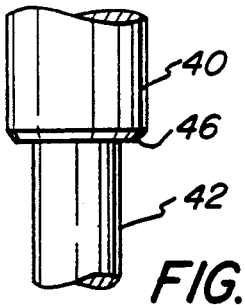
FIG. 4 is a fragmentary side elevational view to an enlarged scale of the lower portion of the tool of FIG. 3.
Figure 5:
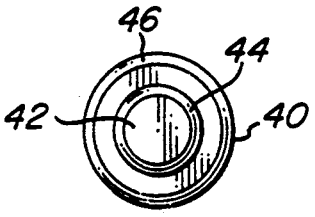
FIG. 5 is a bottom view of the tool on the scale of FIG. 4.

Turning now to FIGS. 3-5, the pin and tip removal tool of the present invention is generally designated by the numeral 38 and it includes an elongated large diameter portion 40 extending from one end which is cooperatively dimensioned to approximate the diameter of the bore 20 of the hinge 10 with which it will be utilized. Extending from the other end of the tool 38 is a smaller diameter portion 42 which is radially dimensioned cooperatively with the passage 36 of the hinge tip 30 so that it will extend therethrough. The two ends of the tip removal tool 38 are chamfered as indicated at the numerals 43, 44, and the shoulder formed at the intersection between the small diameter portion 42 and large diameter portion 40 also is chamfered about its outer edge as indicated at the numeral 46.

In use of the tool 38, the small diameter portion 42 is inserted through the passage 36 in the tip 30 to abut against the end of the shank 26 of the hinge pin 22. An axial driving force is applied to the other end of the tip removal tool 38 as indicated by the arrow 48, and this produces an axial force on the end of the hinge pin 22 causing it to move axially within the bore 20 of the hinge 10 to a point wherein its head 24 may be gripped or acted upon to effect further axial movement and removal completely from the bore 20.

After this has been done, the tip removal tool 38 is inverted and inserted into the opposite end of the barrel 16 so that the small diameter portion 42 now seats in the passage 36 and the shoulder at the end of the large diameter portion 40 seats against the inner end of the shank 34 of the tip 30. Axial force applied to the opposite end of the tip removal tool 38 as indicated by the arrow 50 is translated into an axial force on the tip 30 causing it to move outwardly of the bore 20. At this point, the pin and tip removal tool 38 may be removed from the hinge barrel 16, and the hinge 10 may be fully disassembled.

As will be readily appreciated, the hinge pin and tip removal tool may be fabricated conveniently from various metals to provide a long lived structure. Conveniently, this is done by machining a rod of appropriate length, although a smaller diameter rod may be threaded into or welded to a larger diameter rod. Casting may also be employed.

If so desired, the tool may also be molded or otherwise formed from synthetic resins and composite materials. Moreover, the end of the small diameter portion may be provided with a resin coating or insert to minimize marring.

Although the dimensioning is not critical, it is desirable that the larger diameter portion of the tool approximate the inner diameter of the barrel to provide stable placement of the tool within the barrel. The small diameter portion should have a sufficient diameter to provide strength needed to avoid fracture or bending under the impact forces used upon the tool.

Thus, it can be seen that the hinge and removal tool combination of the present invention enables facile removal of the hinge pin and decorative top without injury to the hinge components. The tool may be fabricated readily and economically.

Having thus described the invention, what is claimed is:

1. In combination with a hinge having a pair of hinge leaves having interfitting knuckles cooperating to provide a barrel with a pin receiving cavity extending therethrough, a hinge pin having a head at one end of said barrel and a shank extending in said barrel cavity and a tip seated in the other end of said barrel cavity and having a passage extending axially therethrough, a pin and tip removal tool of circular cross section having one end portion of a first diameter smaller than said passage in said tip for insertion therethrough to drive said hinge pin away from said tip, said tool having its other end portion of a larger diameter than said passage in said tip and of smaller diameter than the diameter of said cavity of said barrel for insertion into said one end thereof after removal of said pin to drive said tip outwardly of said other end, said other end portion being of greater length than said one end portion, and said tool being of greater length than said barrel.

2. The pin and tip removal tool in accordance with claim 1 wherein said end portions of said tool comprise the full length thereof.

3. The pin and tip removal tool in accordance with claim 2 wherein the ends of said tool are chamfered.

* * * * *